US009234309B2

(12) United States Patent
Lee et al.

(10) Patent No.: US 9,234,309 B2
(45) Date of Patent: Jan. 12, 2016

(54) DETERGENT SUPPLY DEVICE AND WASHING MACHINE HAVING THE SAME

(75) Inventors: Sang Up Lee, Yongin-si (KR); Hong Seok Ko, Yongin-si (KR); Young Hyun Kim, Suwon-si (KR); Seung Youp Lee, Yongin-si (KR); Sang Wook Kim, Suwon-si (KR); Yong Kwon Kim, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 1050 days.

(21) Appl. No.: 12/926,779

(22) Filed: Dec. 8, 2010

(65) Prior Publication Data

US 2011/0154865 A1 Jun. 30, 2011

(30) Foreign Application Priority Data

Dec. 24, 2009 (KR) ..... 10-2009-131147

(51) Int. Cl.
*D06F 39/02* (2006.01)
*D06F 39/08* (2006.01)
*D06F 29/00* (2006.01)

(52) U.S. Cl.
CPC ..... *D06F 39/088* (2013.01); *D06F 39/02* (2013.01)

(58) Field of Classification Search
CPC ..... D06F 39/02; D06F 39/022; D06F 39/088; B05B 11/3001; B05B 11/3067; B05B 11/0048; B05B 11/3023; B05B 11/0064; B05B 11/3016; B05B 11/0072; B05B 11/0075; B05B 11/3021
USPC ..... 68/17 R, 12.18, 207, 200; 222/173, 386, 222/132, 145.1, 145.5, 651; 134/93
See application file for complete search history.

(56) References Cited

U.S. PATENT DOCUMENTS

| | | | | |
|---|---|---|---|---|
| 4,301,948 | A * | 11/1981 | Czech et al. | 222/341 |
| 6,143,257 | A * | 11/2000 | Spriggs et al. | 422/264 |
| 2004/0107740 | A1* | 6/2004 | Kim et al. | 68/17 R |
| 2006/0081016 | A1* | 4/2006 | Hsu et al. | 68/12.18 |
| 2007/0023454 | A1* | 2/2007 | Ophardt | 222/190 |
| 2009/0090141 | A1 | 4/2009 | Deppermann et al. | |
| 2009/0288454 | A1* | 11/2009 | Lee et al. | 68/17 R |
| 2010/0088828 | A1* | 4/2010 | Kim et al. | 8/159 |

FOREIGN PATENT DOCUMENTS

| | | |
|---|---|---|
| CN | 1465798 | 1/2004 |
| EP | 0 499 785 | 8/1992 |

(Continued)

OTHER PUBLICATIONS

Chinese Office Action issued Mar. 25, 2014 in corresponding Chinese Application No. 201010613518.4.

(Continued)

*Primary Examiner* — David Cormier
*Assistant Examiner* — Irina Graf
(74) *Attorney, Agent, or Firm* — Staas & Halsey LLP

(57) ABSTRACT

A washing machine includes a wash tub in which wash water is stored, a detergent supply device to supply detergent into the wash tub, and a water supply hose to supply the wash water from an external water supply source to the detergent supply device and subsequently into the wash tub. Movement of the wash water through the water supply hose is carried out by a hydraulic pressure of an external water supply source in an entire region of the water supply hose.

15 Claims, 13 Drawing Sheets

(56) References Cited

FOREIGN PATENT DOCUMENTS

| | | | | |
|---|---|---|---|---|
| KR | 1990-0004287 | 5/1990 | | |
| KR | 10-0345005 | 9/2002 | | |
| KR | 10-2003-0038108 | 5/2003 | | |
| KR | 10-2009-0101679 | 9/2009 | | |
| KR | 10-2009-0122003 | 11/2009 | | |
| WO | WO-2008/084933 A2 | 7/2008 | * | ..... D06F 29/00 |
| WO | WO 2008/084933 A2 | 7/2008 | | |

OTHER PUBLICATIONS

Korean Office Action issued Sep. 16, 2015 in corresponding Korean Patent Application No. 10-2009-0131147.

* cited by examiner

DETERGENT SUPPLY DEVICE AND WASHING MACHINE HAVING THE SAME

CROSS-REFERENCE TO RELATED APPLICATIONS

This application claims the benefit of Korean Patent Application No. 2009-0131147, filed on Dec. 24, 2009 in the Korean Intellectual Property Office, the disclosure of which is incorporated herein by reference.

BACKGROUND

1. Field

Embodiments relate to a washing machine having an improved detergent supply method.

2. Description of the Related Art

A washing machine is an appliance to remove dirt adhered to laundry using water and detergent. The washing machine may rotate a wash tub mainly using an electric motor as a main power source and may perform a series of washing, rinsing, and dehydration/drying operations.

The washing machine may include a water supply device to supply water. The water supply device is connected to an external water supply source to enable supply of wash water into the wash tub.

In addition, the washing machine may include a detergent supply device to supply detergent. Conventionally, the detergent supply device may be arranged in an upper region of the washing machine. As wash water is supplied by the water supply device, the wash water may be mixed with detergent stored in the detergent supply device while passing through the detergent supply device and thereafter, may free fall into the wash tub.

Alternatively, the detergent supply device may be arranged in a lower region of the washing machine. In this case, a pump is used to move detergent in the detergent supply device to the upper region of the washing machine thus allowing the detergent to be mixed with wash water and free fall into the wash tub.

SUMMARY

Therefore, it is an aspect to provide a washing machine to supply detergent using a hydraulic pressure.

It is another aspect to provide a washing machine in which an installation position of a detergent supply device may be freely changed.

Additional aspects will be set forth in part in the description which follows and, in part, will be apparent from the description, or may be learned by practice of the invention.

In accordance with one aspect, a washing machine includes a wash tub in which wash water is stored, and a water supply hose to supply wash water into the wash tub, wherein movement of the wash water through the water supply hose is carried out by a hydraulic pressure of an external water supply source in an entire region of the water supply hose.

The washing machine may further include a detergent supply device to supply detergent into the wash tub along with the wash water supplied through the water supply hose.

The detergent supply device may include a detergent tank in which the detergent is stored, a valve unit to control supply of the detergent stored in the detergent tank, and a mixing unit in which the wash water supplied via the water supply hose and the detergent supplied via the valve unit are mixed with each other.

The water supply hose may include a front end part provided between the external water supply source at the outside of the cabinet and the mixing unit, and a rear end part provided between the mixing unit and the wash tub.

The mixing unit may include a wash water inlet portion connected to the front end part of the water supply hose for introduction of the wash water, and a wash water outlet portion connected to the rear end part of the water supply hose for discharge of the wash water.

The mixing unit may include a detergent introduction portion connected to the valve unit to receive the detergent.

The valve unit may include a valve body having a predetermined passage, a detergent inlet portion that connects the passage of the valve body and the detergent tank to each other, a detergent outlet portion that connects the passage of the valve body and the mixing unit to each other, and a button that is movable relative to the valve body to control a pressure of the passage of the valve body.

The valve unit may further include a first check valve provided at a connection region of the detergent tank and the valve body, and a second check valve provided at a connection region of the valve body and the mixing unit, and the button may control the pressure of the passage of the valve body to open or close the first check valve or the second check valve.

The detergent supply device may include a detergent tank assembly having a detergent tank in which the detergent is stored, a valve unit to control supply of the detergent stored in the detergent tank, and an inner case in which the detergent tank and the valve unit are mounted; and a mixing unit in which the detergent supplied via the detergent tank assembly and the wash water supplied via the water supply hose are mixed with each other, and the washing machine may further include a restraint unit to allow the detergent tank assembly to be caught by or released from the mixing unit.

The restraint unit may include a guide lever elastically supported on the mixing unit so as to be movable relative to the mixing unit, and a holder fitted to the mixing unit so as to be pivotally rotatable according to movement of the guide lever.

The valve unit of the detergent tank assembly may include a detergent outlet portion connected to the mixing unit, and the valve unit of the detergent tank assembly may further include a holding protrusion formed at the detergent outlet portion so as to be caught by the holder.

The detergent tank assembly may include at least one supporting portion to allow the detergent tank assembly to be supported obliquely.

The detergent tank assembly may include at least one hook to keep the detergent tank assembly at a fixed position.

The detergent supply device may further include an outer case in which the detergent tank assembly and the mixing unit are mounted; and a cover to open or close a front side of the outer case.

The detergent tank may include a detergent gauge display made of a transparent material to display a residual amount of the detergent, and the cover may include a detergent gauge display hole through which the detergent gauge display penetrates.

The cover may further include a button hole through which a button of the valve unit penetrates.

The detergent supply device may be installed at a position lower than the wash tub.

In accordance with another aspect, a washing machine includes a cabinet, a wash tub accommodated in the cabinet, a water supply hose to supply wash water into the wash tub, and a detergent supply device provided at a position of the water supply hose and serving to supply detergent into the wash tub along with the wash water supplied through the water supply hose, wherein the wash water is supplied through the water supply hose from a position, having passed through the detergent supply device, into the wash tub by a hydraulic pressure of a water supply source provided at the outside of the cabinet.

In accordance with a further aspect, a detergent supply device, which is provided at a position of a water supply hose to supply detergent into a wash tub along with wash water, is connected to a front end part of the water supply hose for introduction of the wash water and a rear end part of the water supply hose for discharge of the wash water, wherein the wash water is supplied into the wash tub through the rear end part of the water supply hose by a hydraulic pressure of an external water supply source.

The detergent supply device may include a detergent tank in which the detergent is stored, a valve unit to control supply of the detergent stored in the detergent tank, and a mixing unit in which the wash water supplied via the water supply hose and the detergent supplied via the valve unit are mixed with each other.

The mixing unit may include a detergent introduction portion connected to the valve unit to receive the detergent, a wash water inlet portion connected to the front end part of the water supply hose for introduction of the wash water, and a wash water outlet portion connected to the rear end part of the water supply hose for discharge of the wash water, and the valve unit may prevent the wash water introduced into the mixing unit through the front end part of the water supply hose from being discharged through the detergent introduction portion.

The valve unit may include a detergent outlet portion connected to the detergent introduction portion, and a check valve installed to the detergent outlet portion.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
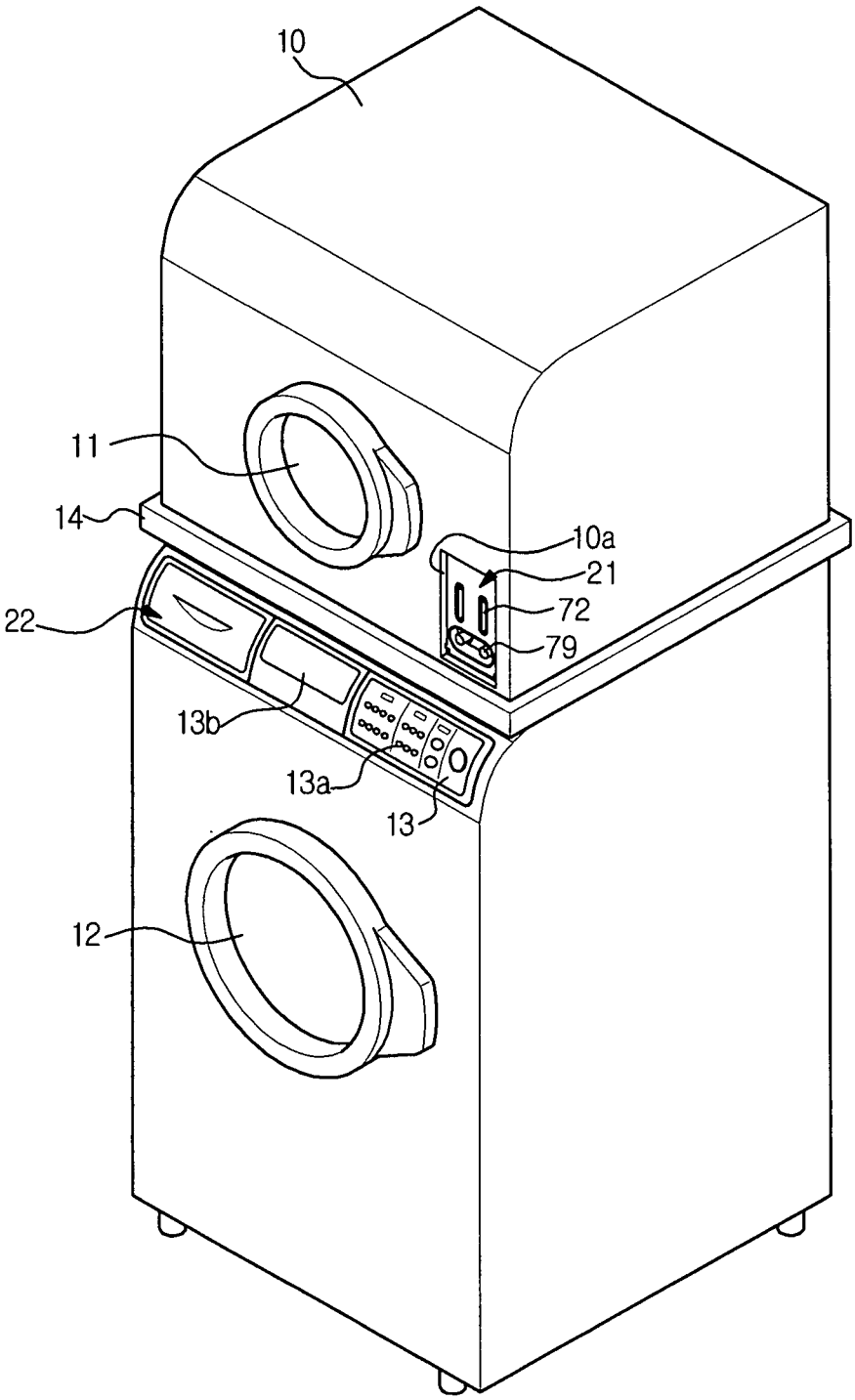
FIG. 1 is a perspective view illustrating an exterior appearance of a washing machine according to an embodiment.

Reference will now be made in detail to the embodiments, examples of which are illustrated in the accompanying drawings, wherein like reference numerals refer to like elements throughout.

Figure 2:
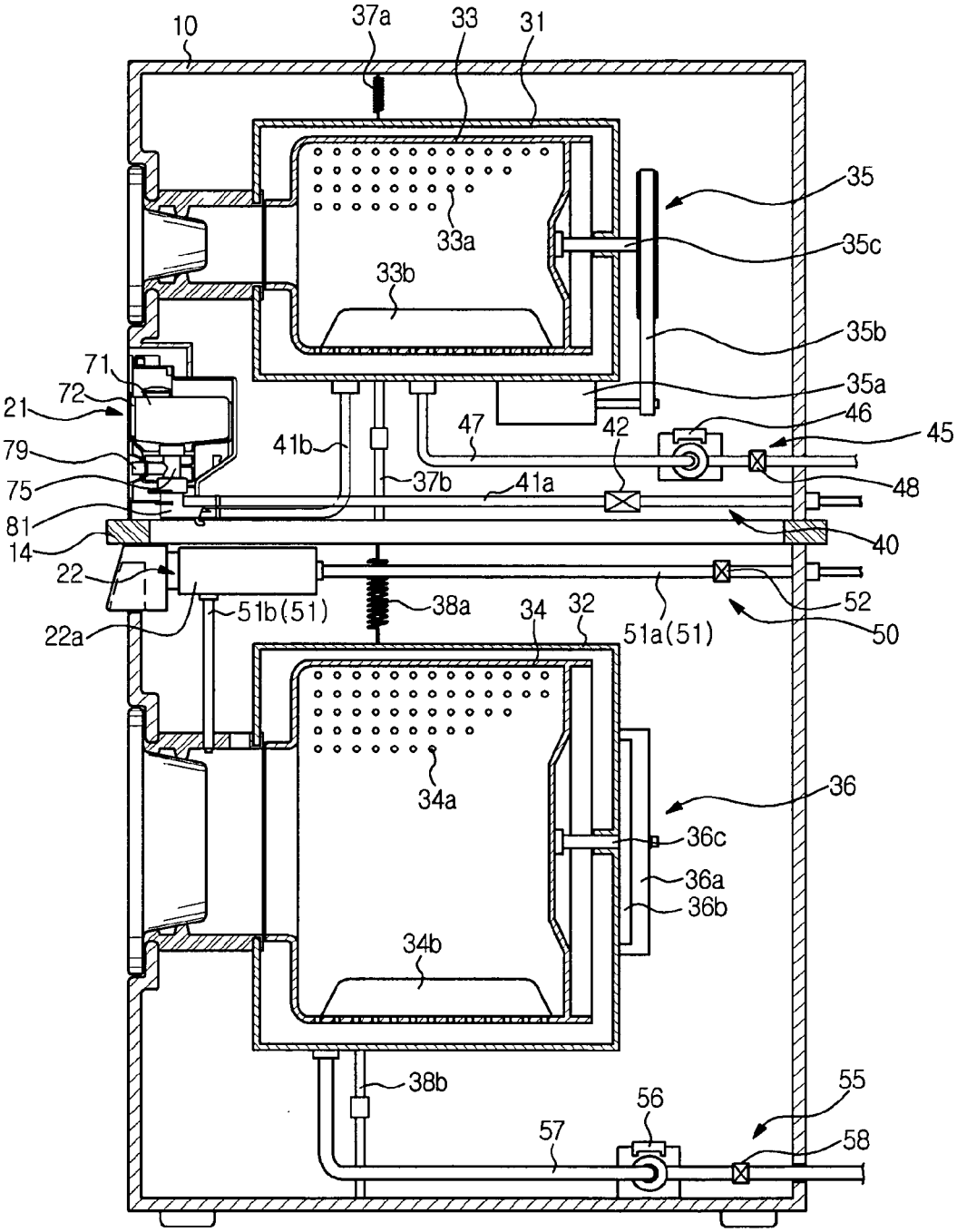
FIG. 2 is a side sectional view illustrating a configuration of the washing machine according to the embodiment.
Figure 3:
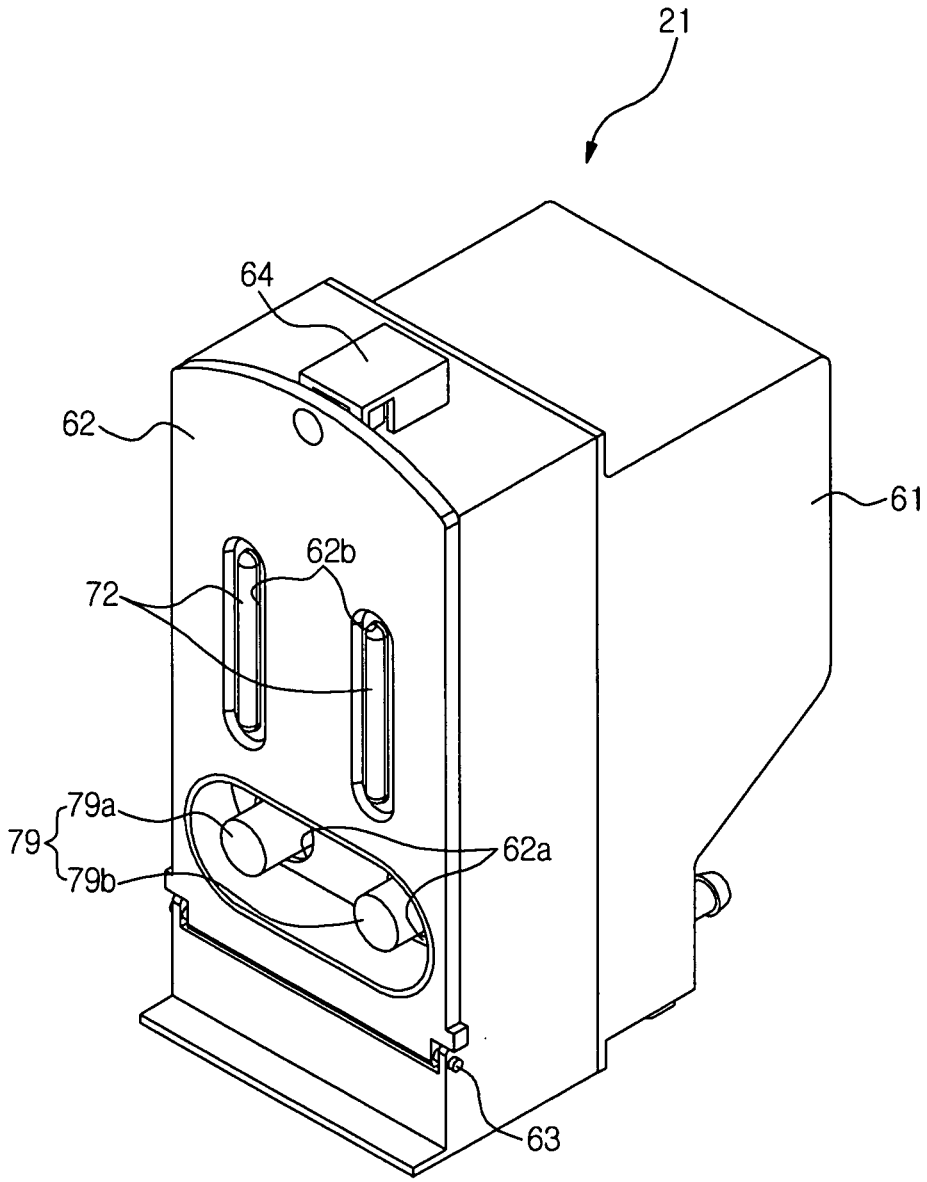
FIG. 3 is a front perspective view of a detergent supply device according to the embodiment.
Figure 4:
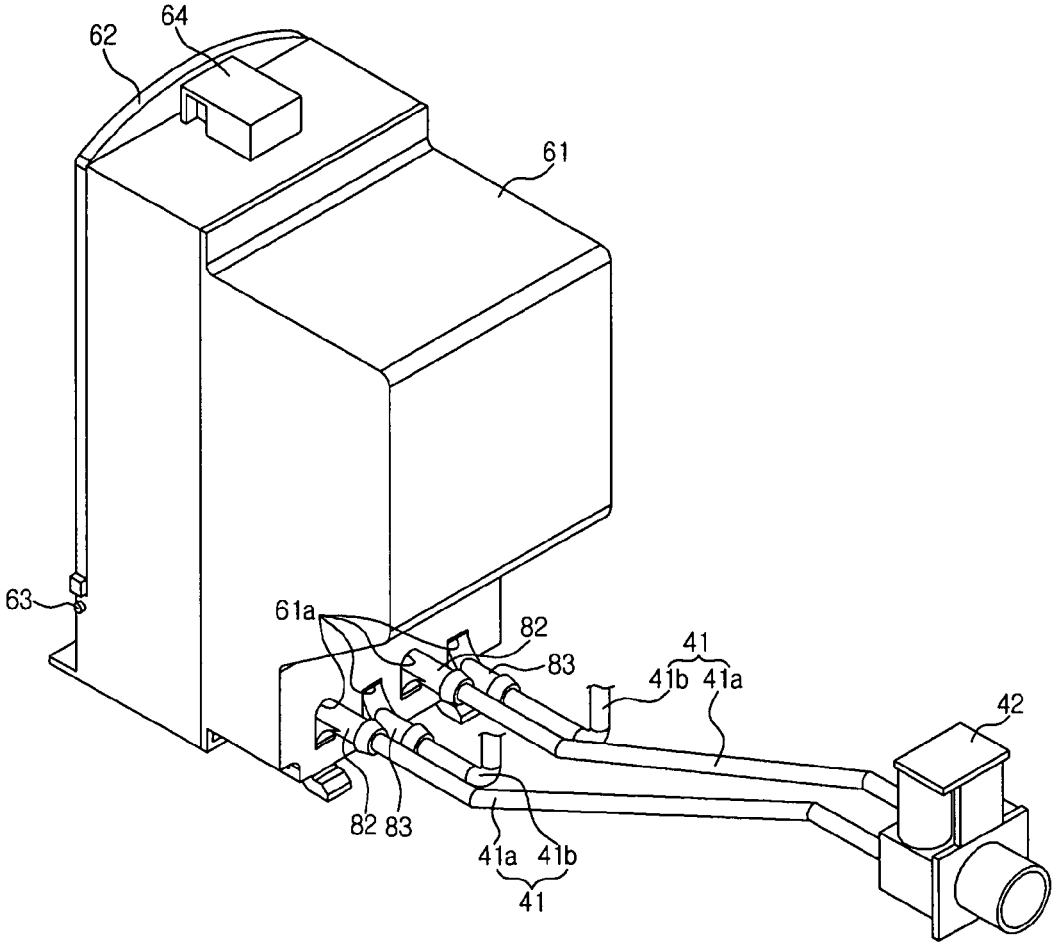
FIG. 4 is a rear perspective view of the detergent supply device according to the embodiment.
Figure 5:
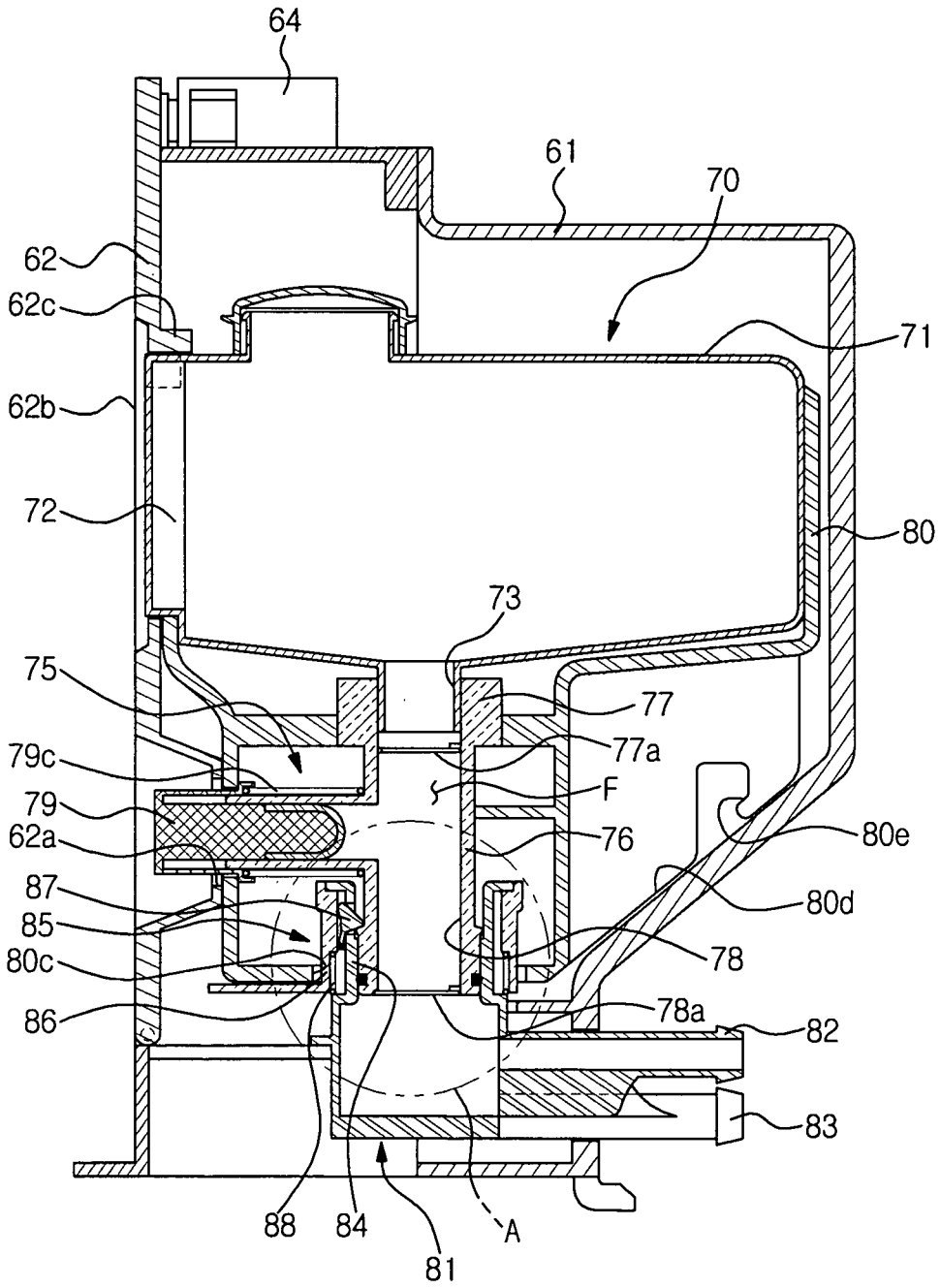
FIG. 5 is a side sectional view of the detergent supply device according to the embodiment.
Figure 6:
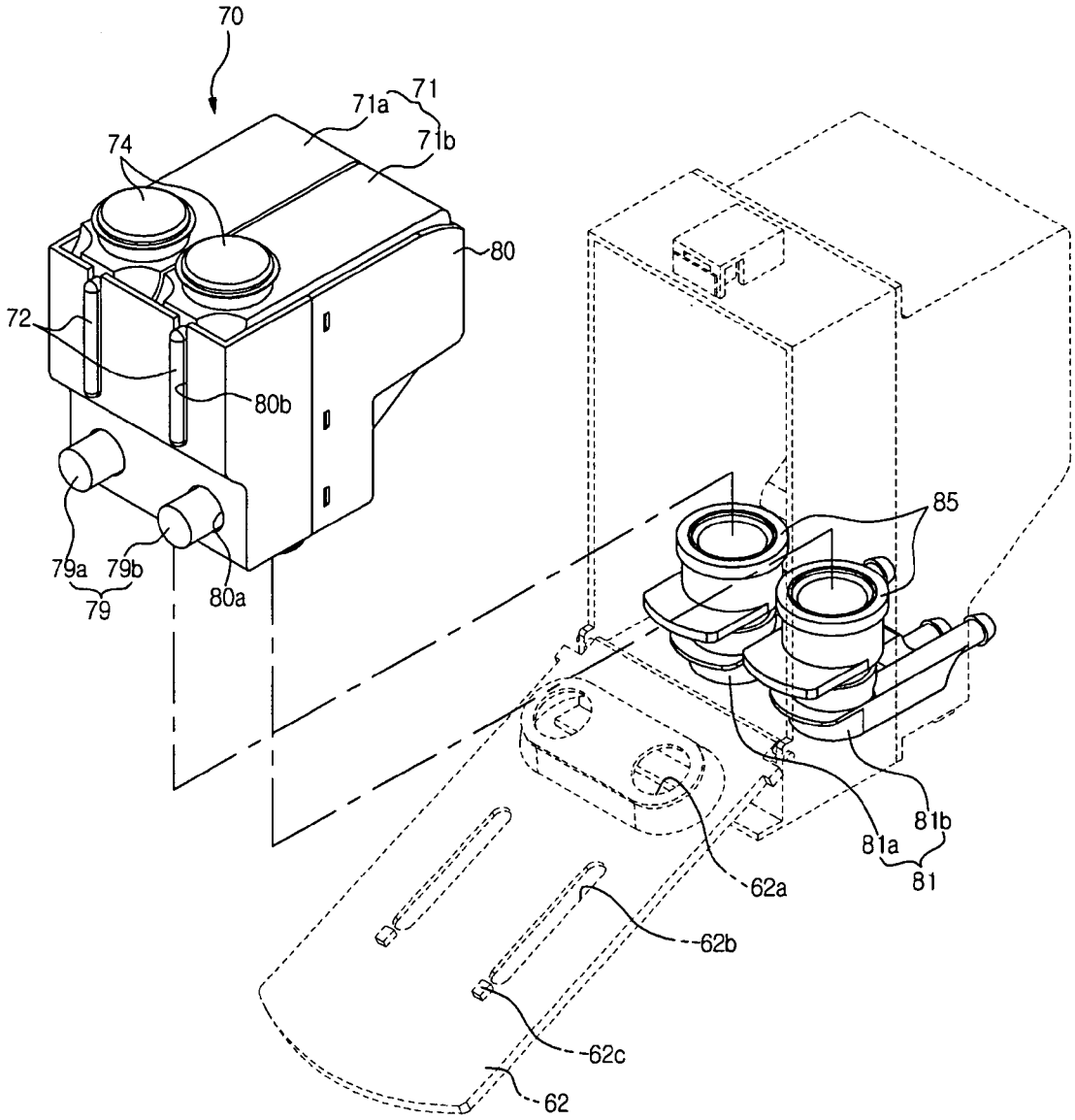
FIG. 6 is a view illustrating a detergent tank assembly separated from an outer case according to the embodiment.

FIG. 1 is a perspective view illustrating an exterior appearance of a washing machine according to an embodiment, and FIG. 2 is a side sectional view illustrating a configuration of the washing machine according to the embodiment. FIGS. 3 and 4 are respectively a front perspective view and a rear perspective view of a detergent supply device according to the embodiment, and FIG. 5 is a side sectional view of the detergent supply device according to the embodiment. Also, FIG. 6 is a view illustrating a detergent tank assembly separated from an outer case according to the embodiment.

As illustrated in FIGS. 1 to 6, the washing machine may include a cabinet 10, an upper door 11 and a lower door 12 provided at a front surface of the cabinet 10, through which laundry is put into or taken out of the cabinet 10, a control panel 13 provided at the center of the front surface of the cabinet 10, the control panel 13 serving to input an operation command of the washing machine and to display information related to washing, such as a washing course, washing time or the like, and an upper detergent supply device 21 and a lower detergent supply device 22 provided at the front surface of the cabinet 10 to enable supply of detergent.

A user may put laundry into the cabinet 10 by opening the upper or lower door 11 or 12 and after completion of washing, may take laundry out of the cabinet 10 by opening the upper or lower door 11 or 12.

The control panel 13 may include an input part 13*a* to input an operation command of the washing machine, and a display part 13*b* to display information related to washing, such as a washing course, washing time or the like.

The input part 13*a* may include an On/Off button, a play/pause button to initiate operation of the washing machine, a wash tub selection button to select wash tub(s) so that a plurality of wash tubs performs a simultaneous washing or independent washing operation, and course/function selection buttons to select a washing course and washing function of each wash tub.

The display part 13*b* may inform a user of washing operation and status of the washing machine by use of light emitting devices, such as Light Emitting Diodes (LEDs).

The upper detergent supply device 21 may be used to supply detergent into an upper wash tub 31, and the lower detergent supply device 22 may be used to supply detergent into a lower wash tub 32. The upper detergent supply device 21 may be mounted in a front right region of the cabinet 10 at a height lower than the upper wash tub 31. The lower detergent supply device 22 may be mounted in a front left region of the cabinet 10 at a height higher than the lower wash tub 32. The upper detergent supply device 21 and the lower detergent supply device 22 may be installed at positions which the user may conveniently access.

In an alternative embodiment, the upper detergent supply device 21 and the lower detergent supply device 22 may be unified rather than being provided separately. Specifically, any one of the upper detergent supply device 21 and the lower detergent supply device 22 may supply detergent into each of the upper wash tub 31 and the lower wash tub 32.

The washing machine may include the upper and lower wash tubs 31 and 32 accommodated in the cabinet 10 to store wash water therein, upper and lower drums 33 and 34 rotatably accommodated respectively in the upper and lower wash tubs 31 and 32, and upper and lower drive devices 35 and 36 to apply drive power to the upper and lower drums 33 and 34 respectively.

The interior space of the cabinet 10 may be divided into upper and lower spaces by a partition 14.

The upper wash tub 31 may be installed in the upper space of the cabinet 10 by use of a first elastic member 37*a* and a first damper 37*b*, and the lower wash tub 32 may be installed in the lower space of the cabinet 10 by use of a second elastic member 38*a* and a second damper 38*b*.

The upper wash tub 31 and the lower wash tub 32 have a cylindrical shape and may have the same basic configuration as each other. However, the upper wash tub 31 may have a relatively small size to perform a small capacity washing operation, whereas the lower wash tub 32 may have a relatively large size to perform a large capacity washing operation. In an alternative embodiment, the upper wash tub 31 and the lower wash tub 32 may have the same size as each other to have equal capacities.

The upper drum 33 may be rotatably provided in the upper wash tub 31, and the lower drum 34 may be rotatably provided in the lower wash tub 32. The upper drum 33 and the lower drum 34 may have the same basic configuration as each other. For example, the respective drums 33 and 34 may have communicating holes 33*a* and 34*a* through which wash water penetrates, and lifters 33*b* and 34*b* formed at inner surfaces thereof to raise and drop wash water or laundry.

The upper drive device 35 may include a motor 35*a* and a belt 35*b*. Drive power of the motor 35*a* may be transmitted to an upper rotating shaft 35*c* via the belt 35*b*. In an alternative embodiment, the upper drum 33 may be driven by a directly coupled motor, i.e. a rotor and a stator.

The lower drive device 36 may be a directly coupled motor including a rotor 36*a* and a stator 36*b*. As the rotor 36*a* is rotated by electromagnetic force between the rotor 36*a* and the stator 36*b*, rotation force of the rotor 36*a* may be transmitted to a lower rotating shaft 36*c*. In an alternative embodiment, the lower drum 34 may be driven by a motor and a belt.

The washing machine may include upper and lower water supply devices 40 and 50 provided respectively to supply wash water into the upper and lower wash tubs 31 and 32, and upper and lower drain devices 45 and 55 provided respectively to discharge the wash water of the upper and lower wash tubs 31 and 32 out of the cabinet 10.

The upper water supply device 40 may include a first water supply hose 41 and a first water supply valve 42. When the first water supply valve 42 is opened, wash water supplied from an external water supply source (not shown) may be supplied into the upper wash tub 31 through the first water supply hose 41. The upper detergent supply device 21 is located at a certain position of the first water supply hose 41. Therefore, the wash water passing through the first water supply hose 41 is mixed with detergent stored in the upper detergent supply device 21 while passing through the upper detergent supply device 21, thereby being supplied along with the detergent. Here, the wash water mixed with the detergent within the upper detergent supply device 21 may be moved into the upper wash tub 31 by a hydraulic pressure of the external water supply source.

The lower water supply device 50 may include a second water supply hose 51 and a second water supply valve 52. When the second water supply valve 52 is opened, wash water supplied from the external water supply source (not shown) may be supplied into the lower wash tub 32 through the second water supply hose 51. In this case, the wash water passing through the second water supply hose 51 is mixed with detergent stored in the lower detergent supply device 22 while passing through the lower detergent supply device 22, thereby being supplied along with the detergent. Here, the wash water mixed with the detergent within the lower detergent supply device 22 may free fall into the lower wash tub 32.

The upper drain device 45 may include a first drain pump 46, a first drain hose 47, and a first drain valve 48. When the first drain valve 48 is opened, the wash water of the upper wash tub 31 pumped by the first drain pump 46 may be discharged out of the cabinet 10 through the first drain hose 47.

The lower drain device 55 may have the same configuration as the upper drain device 45. The lower drain device 55 may include a second drain pump 56, a second drain hose 57, and a second drain valve 58. When the second drain valve 58 is opened, the wash water of the lower wash tub 32 pumped by the second drain pump 56 may be discharged out of the cabinet 10 through the second drain hose 57.

Hereinafter, the upper detergent supply device 21 will be described in detail. It is noted that the following description is concentrated on the upper detergent supply device 21 except for the case where distinction between the upper detergent supply device 21 and the lower detergent supply device 22 is necessary.

The washing machine may include a detergent supply device installation opening 10*a* formed in the front surface of the cabinet 10. The detergent supply device installation opening 10*a* may be located below the upper wash tub 31, and the detergent supply device 21 may be inserted into the detergent supply device installation opening 10*a*. The detergent supply device 21 is located below the upper wash tub 31 to allow the user to conveniently manage the detergent supply device 21.

The detergent supply device 21 may be provided at a certain position of the first water supply hose 41. The first water supply hose 41 may consist of a front end part 41*a* that connects the external water supply source (not shown) and the detergent supply device 21 to each other, and a rear end part 41*b* that connects the detergent supply device 21 and the upper wash tub 31 to each other.

The wash water may be moved into the detergent supply device 21 through the front end part 41*a* of the first water supply hose 41 by the hydraulic pressure of the external water supply source and then, from the detergent supply device 21 into the upper wash tub 31 through the rear end part 41*b* of the first water supply hose 41 by the hydraulic pressure of the external water supply source. The detergent supply device 21 may be configured to maintain the hydraulic pressure of the external water supply source in an entire region of the first water supply hose 41. Accordingly, although the detergent supply device 21 is located below the upper wash tub 31, the wash water supplied through the first water supply hose 41 may be smoothly moved into the upper wash tub 31 after passing through the detergent supply device 21.

A plurality of first water supply hoses 41 may be provided. Specifically, the first water supply hose 41 may be diverged into a plurality of first water supply hoses from the first water supply valve 42, and the respective first water supply hoses 41 may be connected to the detergent supply device 21. Here, the wash water having passed through any one of the plurality of first water supply hoses 41 may be mixed with liquid-phase detergent in the detergent supply device 21, and the wash water having passed through another one of the plurality of first water supply hoses 41 may be mixed with fabric softener.

The detergent supply device 21 may include an outer case 61, a detergent tank assembly 70 mounted in the outer case 61, a mixing unit 81 communicating with the detergent tank assembly 70, and a cover 62 to open or close a front side of the outer case 61.

The outer case 61 may have an open front side, and may be kept at a fixed position inside the front surface of the cabinet 10. In this case, the outer case 61 may be installed such that the open front side of the outer case 61 may coincide with the detergent supply device installation opening 10*a* of the cabinet 10.

A plurality of holes 61*a* may be perforated in a rear wall of the outer case 61. A tubular wash water inlet portion 82 and a tubular wash water outlet portion 83 of the mixing unit 81 may penetrate through the plurality of holes 61*a* and be connected to the first water supply hose 41.

The cover 62 may be installed to open or close the front side of the outer case 61. The cover 62 and the outer case 61 may include at least one hinge coupling structure 63. The cover 62 may be pivotally rotatably hinged at a lower end thereof to the outer case 61. In addition, the cover 62 and the outer case 61 may include at least one locking structure 64. The cover 62 may open or close the front side of the outer case 61 as an upper end of the cover 62 is locked with or unlocked from the outer case 61.

The cover 62 may have a button hole 62*a*, such that a button 79 of a valve unit 75 may be exposed to the front of the cabinet 10 through the button hole 62*a* of the cover 62. The user in front of the cabinet 10 may push the button 79 to initiate supply of detergent or to adjust a supply amount of detergent.

The cover 62 may further have a first detergent gauge display hole 62*b*. A detergent gauge display 72 of a detergent tank 71 may be exposed to the front of the cabinet 10 through the first detergent gauge display hole 62*b*. The user in front of the cabinet 10 may sense a residual amount of detergent by observing the detergent gauge display 72 of the detergent tank 71.

The cover 62 may be provided at a rear surface thereof with an anti-separation protrusion 62*c*. When the cover 62 is closed, the anti-separation protrusion 62*c* of the cover 62 presses an upper surface of the detergent tank 71 downward, thereby preventing vertical movement of the detergent tank 71.

The detergent tank assembly 70 may include the detergent tank 71 in which detergent is stored, the valve unit 75 to pump and move the detergent stored in the detergent tank 71 into the mixing unit 81, and an inner case 80 in which the detergent tank 71 and the valve unit 75 are mounted.

A plurality of detergent tanks 71 may be provided. For example, a first detergent tank 71*a* may store liquid-phase detergent, and a second detergent tank 71*b* may store fabric softener.

A cap 74 may be separably provided at the upper surface of the detergent tank 71 to allow the user to supplement liquid-phase detergent or fabric softener by separating the cap 74. A nozzle 73 may be formed at a lower surface of the detergent tank 71 to discharge detergent out of the detergent tank 71. The detergent gauge display 72 may protrude from a front surface of the detergent tank 71. The detergent gauge display 72 may be vertically installed at the same height as the detergent tank 71. The detergent tank 71 may be made of a transparent or semi-transparent material and therefore, the user at the outside of the cabinet 10 may recognize a residual amount of detergent in the detergent tank 71 by observing the height of detergent measured by the detergent gauge display 72.

A plurality of valve units 75 may be provided. For example, the first detergent tank 71*a* and the second detergent tank 71*b* may be provided respectively with the valve units 75.

The valve unit 75 may include a valve body 76 defining a predetermined passage F, a tubular detergent inlet portion 77 that extends upward from the valve body 76 and is coupled to the detergent tank 71, a first check valve 77*a* provided at the detergent inlet portion 77, a tubular detergent outlet portion 78 that extends downward from the valve body 76 and is coupled to the mixing unit 81, a second check valve 78*a* provided at the detergent outlet portion 78, and the button 79 that extends forward from the valve body 76 and is elastically supported by the valve body 76.

The detergent inlet portion 77 of the valve unit 75 may be fitted around the nozzle 73 of the detergent tank 71. When the first check valve 77*a* is opened, the detergent stored in the detergent tank 71 may be moved into the valve body 76 through the detergent inlet portion 77. The first check valve 77*a* allows the detergent to be moved only in a given direction, thus preventing backflow of the detergent.

At least a part of the detergent outlet portion 78 of the valve unit 75 may protrude downward from a lower surface of the inner case 80 and thus, may be fitted into a detergent introduction portion 84 of the mixing unit 81. When the second check valve 78*a* is opened, the detergent stored in the passage F of the valve body 76 may be moved into the mixing unit 81 through the detergent outlet portion 78. The second check valve 78*a* allows the detergent to be moved only in a given direction, thus preventing backflow of the detergent. The second check valve 78*a* may also serve to prevent wash water of the mixing unit 81 from backflowing into the valve unit 75.

The button 79 of the valve unit 75 may be elastically supported by a first elastic member 79*c*. When the button 79 is pushed, a pressure of the passage F of the valve body 76 is increased, whereby the first check valve 77*a* is kept in a closed state and the second check valve 78*a* is opened. In this case, the detergent inside the valve unit 75 may be moved into the mixing unit 81 through the second check valve 78*a*. Thereafter, when the button 79 is returned to an original position thereof by elasticity of the first elastic member 79*c*, the pressure of the passage F of the valve body 76 is decreased, whereby the first check valve 77*a* is opened and the second check valve 78*a* is kept in a closed state. In this case, the detergent of the detergent tank 71 may be moved into the valve unit 75 through the first check valve 77*a*.

The detergent tank assembly 70 may be completed by mounting the detergent tank 71 and the valve unit 75 into the inner case 80. The inner case 80 may have a second detergent amount display hole 80*b* through which the detergent gauge display 72 of the detergent tank 71 may penetrate, a second button hole 80*a* through which the button 79 of the valve unit 75 may penetrate, and a detergent discharge hole 80*c* through which the detergent outlet portion 78 of the valve unit 75 may penetrate.

Figure 7:
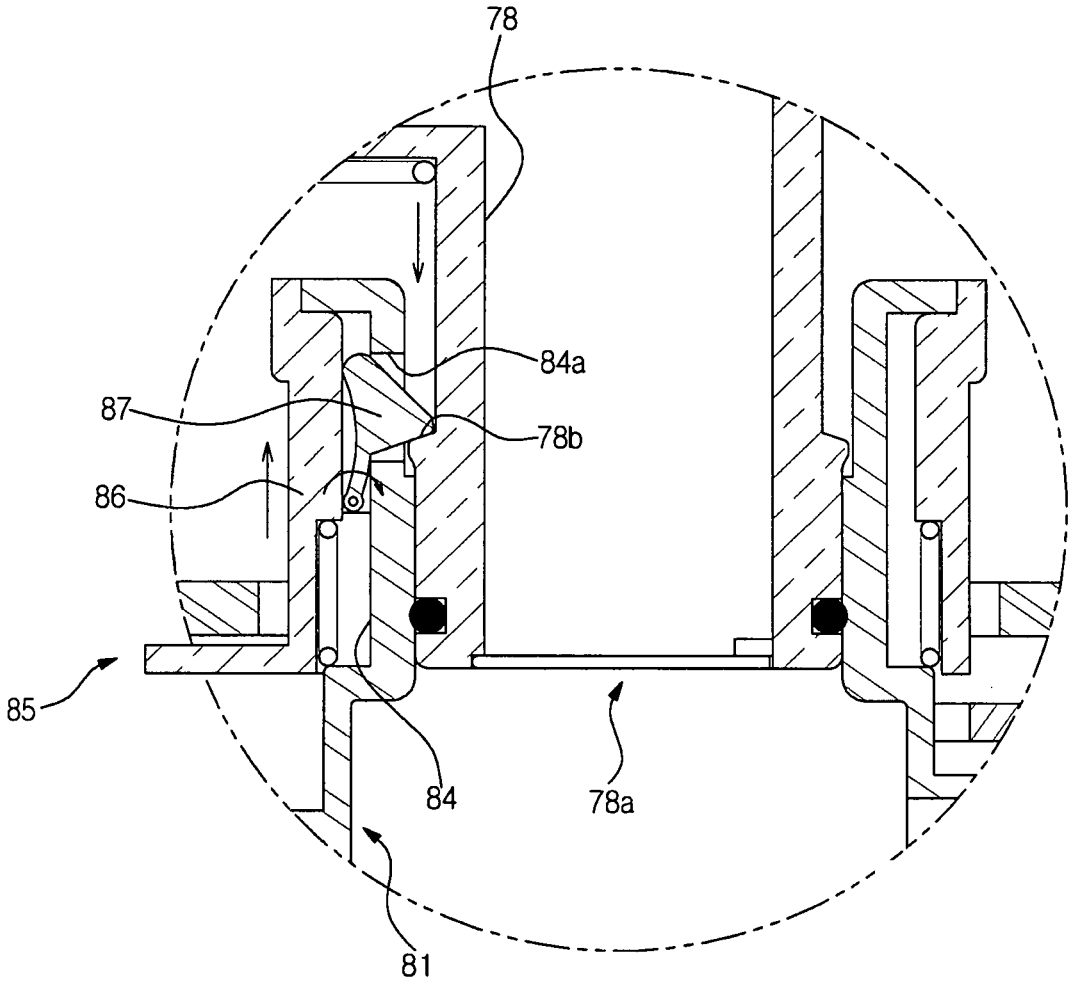
FIG. 7 is an enlarged view of the portion A of FIG. 5 illustrating the detergent tank assembly caught by a mixing unit according to the embodiment.
Figure 8:
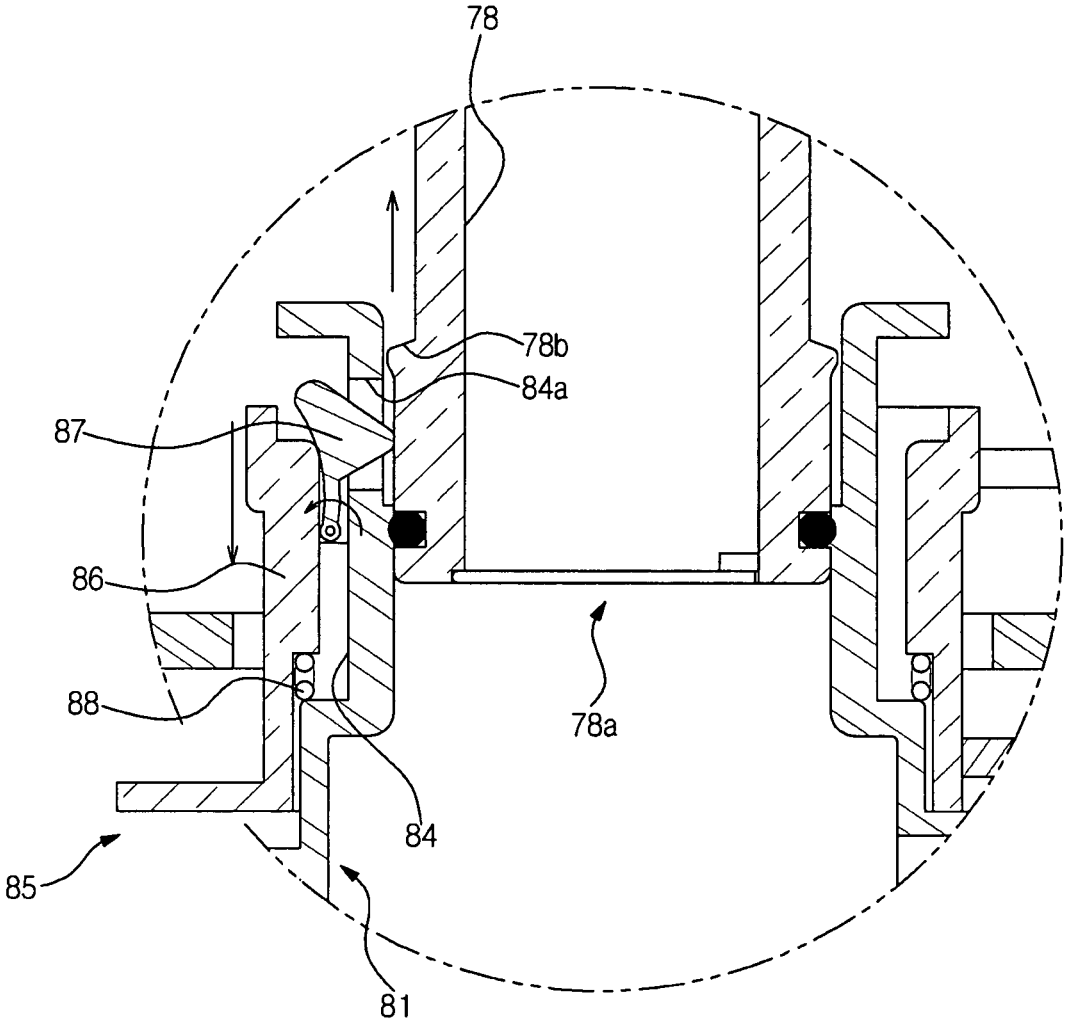
FIG. 8 is an enlarged view of the portion A of FIG. 5 illustrating the detergent tank assembly released from the mixing unit according to the embodiment.

FIG. 7 is an enlarged view of the portion A of FIG. 5 illustrating the detergent tank assembly caught by the mixing unit according to the embodiment, and FIG. 8 is an enlarged view of the portion A of FIG. 5 illustrating the detergent tank assembly released from the mixing unit according to the embodiment.

As illustrated in FIGS. 1 to 8, the detergent tank assembly 70 may be detachably caught by the mixing unit 81. The user may separate the detergent tank assembly 70 from the mixing unit 81 to supplement detergent and after supplementing detergent, may again couple the detergent tank assembly 70 to the mixing unit 81.

A restraint unit 85 may be installed to the mixing unit 81. The restraint unit 85 may allow, the detergent tank assembly 70 to be caught by or released from the mixing unit 81. More specifically, the restraint unit 85 may restrain or release the detergent outlet portion 78 of the valve unit 75.

The restraint unit 85 may include a guide lever 86, and a holder 87 to be pressed by the guide lever 86.

The guide lever 86 is elastically supported on the detergent introduction portion 84 by a second elastic member 88 and thus, is movable relative to the detergent introduction portion 84. The holder 87 may be pivotally rotatably fitted to the detergent introduction portion 84. The detergent introduction portion 84 may be formed with a communicating hole 84*a* to enable pivotal rotation of the holder 87.

As illustrated in FIG. 8, when the user presses and moves the guide lever 86 downward, the holder 87 is pivotally rotated to be released from a restraint protrusion 78*b* of the detergent outlet portion 78. In this case, the user may separate the detergent tank assembly 70 from the mixing unit 81. On the contrary, as illustrated in FIG. 7, when the guide lever 86 is moved upward by the second elastic member 88, the holder 87 is pivotally rotated to be caught by the restraint protrusion 78*b* of the detergent outlet portion 78. In this case, the detergent tank assembly 70 may be coupled to the mixing unit 81 by the restraint unit 85.

A plurality of mixing units 81 may be provided. For example, a first mixing unit 81*a* may communicate with the valve unit 75 communicating with the first detergent tank 71*a*, and a second mixing unit 81*b* may communicate with the valve unit 75 communicating with the second detergent tank 71*b*.

The mixing unit 81 may function to mix wash water and detergent with each other. The mixing unit 81 may include a wash water inlet portion 82 and a wash water outlet portion 83 for movement of wash water. The wash water inlet portion 82 of the mixing unit 81 protrudes out of the outer case 61 through the hole 61*a* of the outer case 61 and thus, may be connected to the front end part 41*a* of the first water supply hose 41. The wash water outlet portion 83 of the mixing unit 81 also protrudes out of the outer case 61 through the hole 61*a* of the outer case 61 and thus, may be connected to the rear end part 41*b* of the first water supply hose 41.

The mixing unit 81 may include the detergent introduction portion 84. The detergent introduction portion 84 of the mixing unit 81 communicates with the detergent outlet portion 78 of the valve unit 75 and therefore, the detergent of the detergent tank 71 may be supplied into the mixing unit 81 through the valve unit 75. The second check valve 78*a* installed to the detergent outlet portion 78 of the valve unit 75 may prevent wash water of the mixing unit 81 from backflowing into the valve unit 75.

In conclusion, wash water supplied from the external water supply source may be moved into the wash water outlet portion 82 of the mixing unit 81 through the front end part 41*a* of the first water supply hose 41 by the hydraulic pressure of the external water supply source. In this case, if the user pushes the button 79 to supply detergent, the detergent may be mixed with the wash water passing through the mixing unit 81. Thereafter, the wash water mixed with the detergent may be moved to the rear end part 41*b* of the first water supply hose 41 through the wash water outlet portion 83 of the mixing unit 81. Since the hydraulic pressure of the external water supply source is continuously transmitted to the rear end part 41*b* of the first water supply hose 41, the wash water mixed with the detergent may be supplied into the upper wash tub 31 by the hydraulic pressure.

Figure 9:
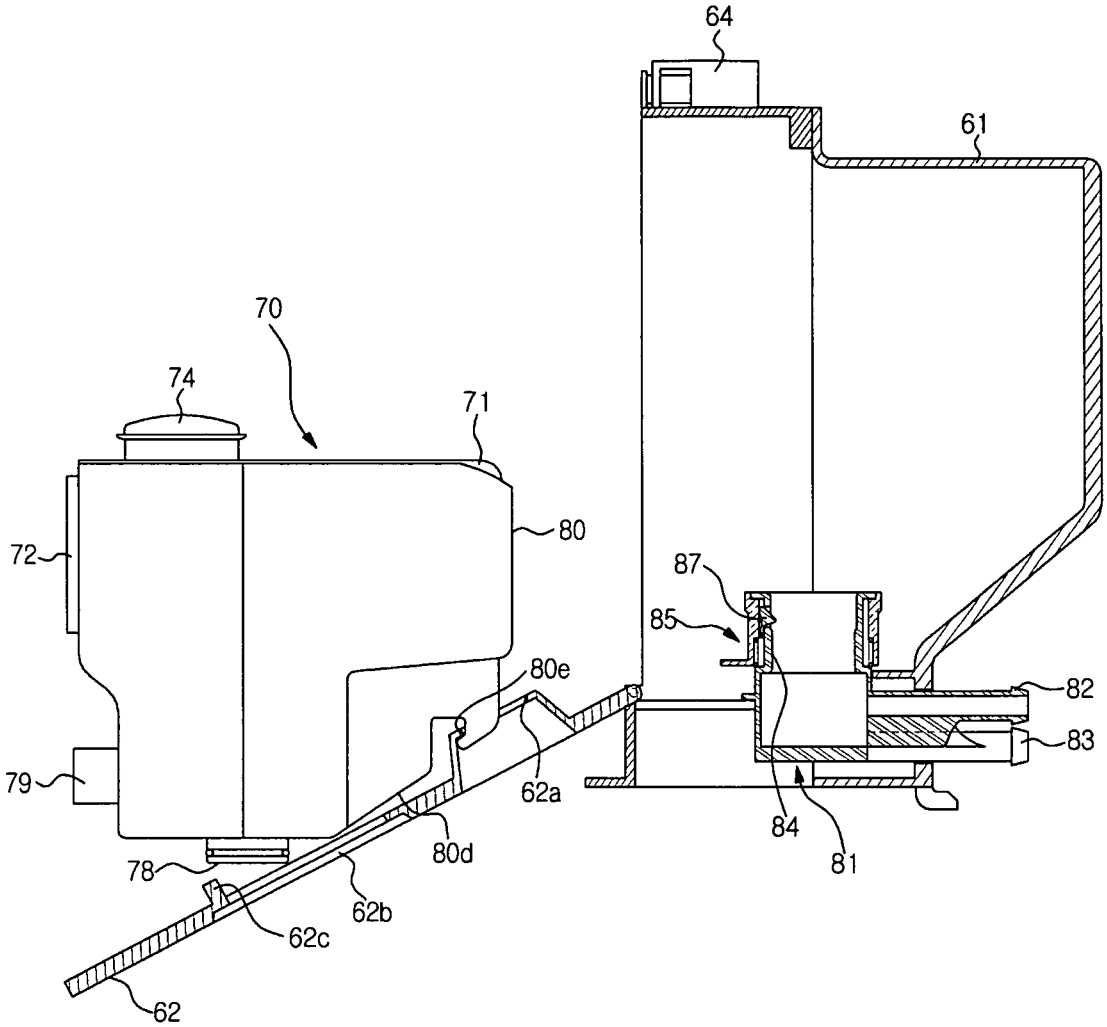
FIG. 9 is a sectional view illustrating the detergent tank assembly mounted on a cover according to the embodiment.
Figure 10:
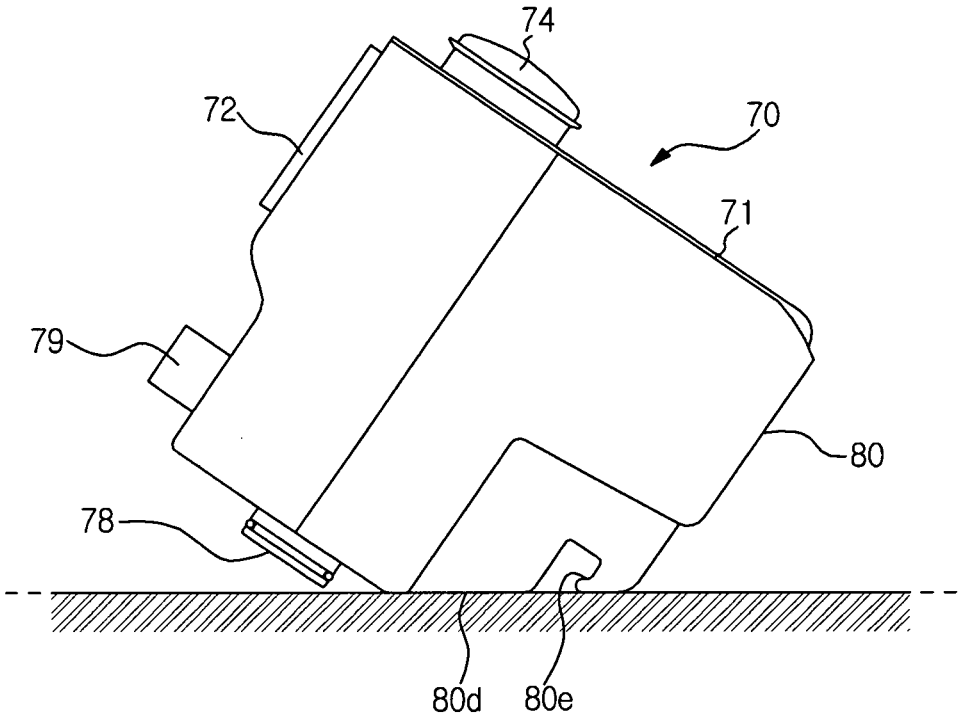
FIG. 10 is a sectional view illustrating the detergent tank assembly placed on the floor.

FIG. 9 is a sectional view illustrating the detergent tank assembly mounted on the cover according to the embodiment, and FIG. 10 is a sectional view illustrating the detergent tank assembly placed on the floor.

As illustrated in FIGS. 1 to 10, the user may remove the detergent tank assembly 70 from the outer case 61 to mount the detergent tank assembly 70 on the cover 62 or to place the detergent tank assembly 70 on the floor. The user may supplement liquid-phase detergent or fabric softener in a state wherein the detergent tank assembly 70 is kept at a fixed position on the cover 62 or on the floor.

The detergent tank assembly 70 may include at least one supporting portion 80*d* to be supported on the floor. Specifically, the at least one supporting portion 80*d* is defined by an oblique rear surface of the inner case 80 such that the detergent tank assembly 70 may be obliquely installed on the floor. Although the detergent outlet portion 78 of the valve unit 75 may protrude downward from the lower surface of the inner case 80, the detergent outlet portion 78 of the valve unit 75 may be spaced apart from the floor in a tilted state of the inner case 80, thus preventing damage to the valve unit 75 due to external shock.

The detergent tank assembly 70 may further include at least one hook 80*e* to be caught by the cover 62. Specifically, the at least one hook 80*e* may be formed at the rear surface of the inner case 80. As the hook 80*e* of the detergent tank assembly 70 is caught by the button hole 62*a* of the cover 62, the detergent tank assembly 70 may be fixed to the cover 62.

Figure 11:
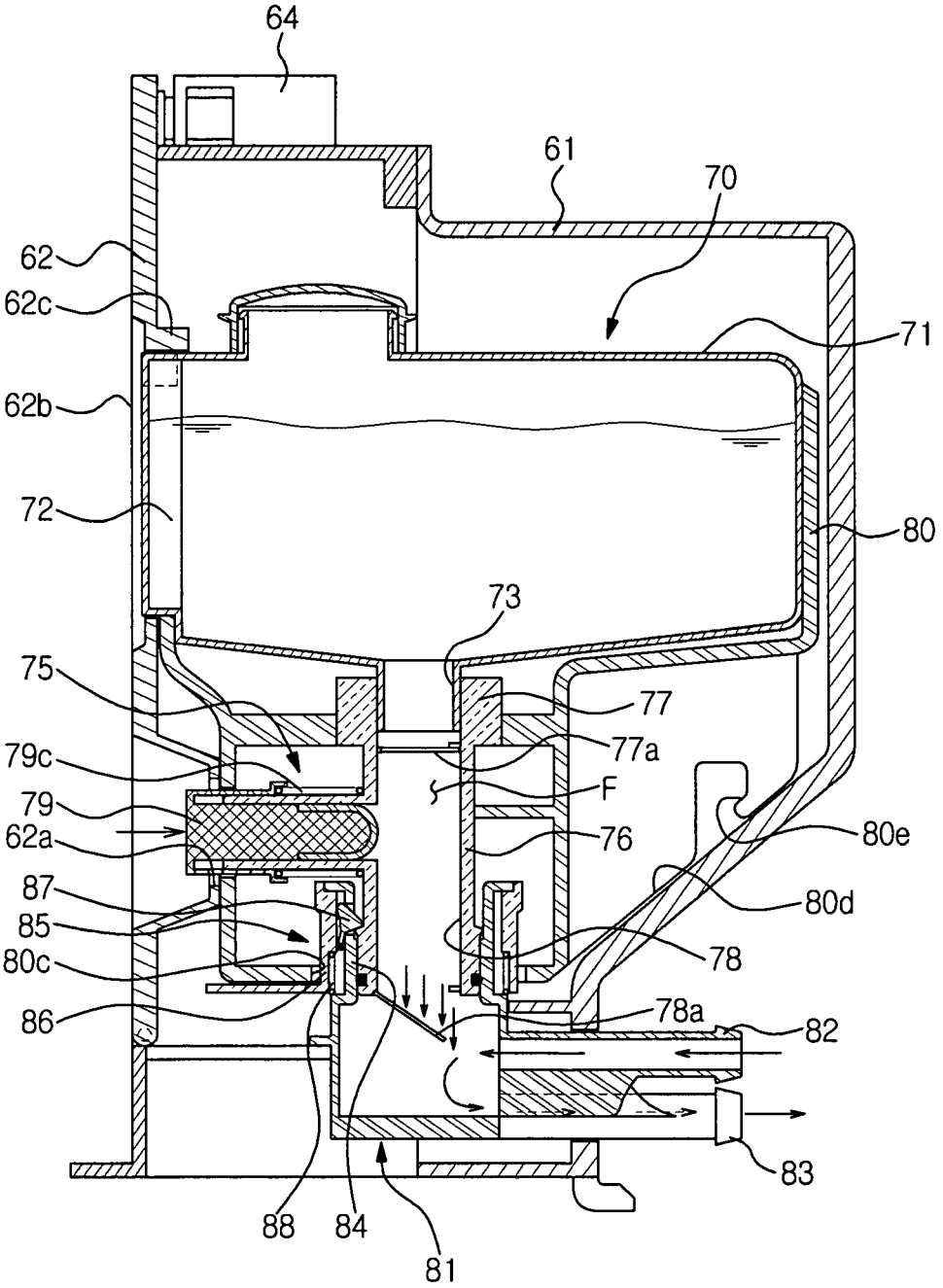
FIG. 11 is a sectional view illustrating supply of detergent via the detergent supply device according to the embodiment.
Figure 12:
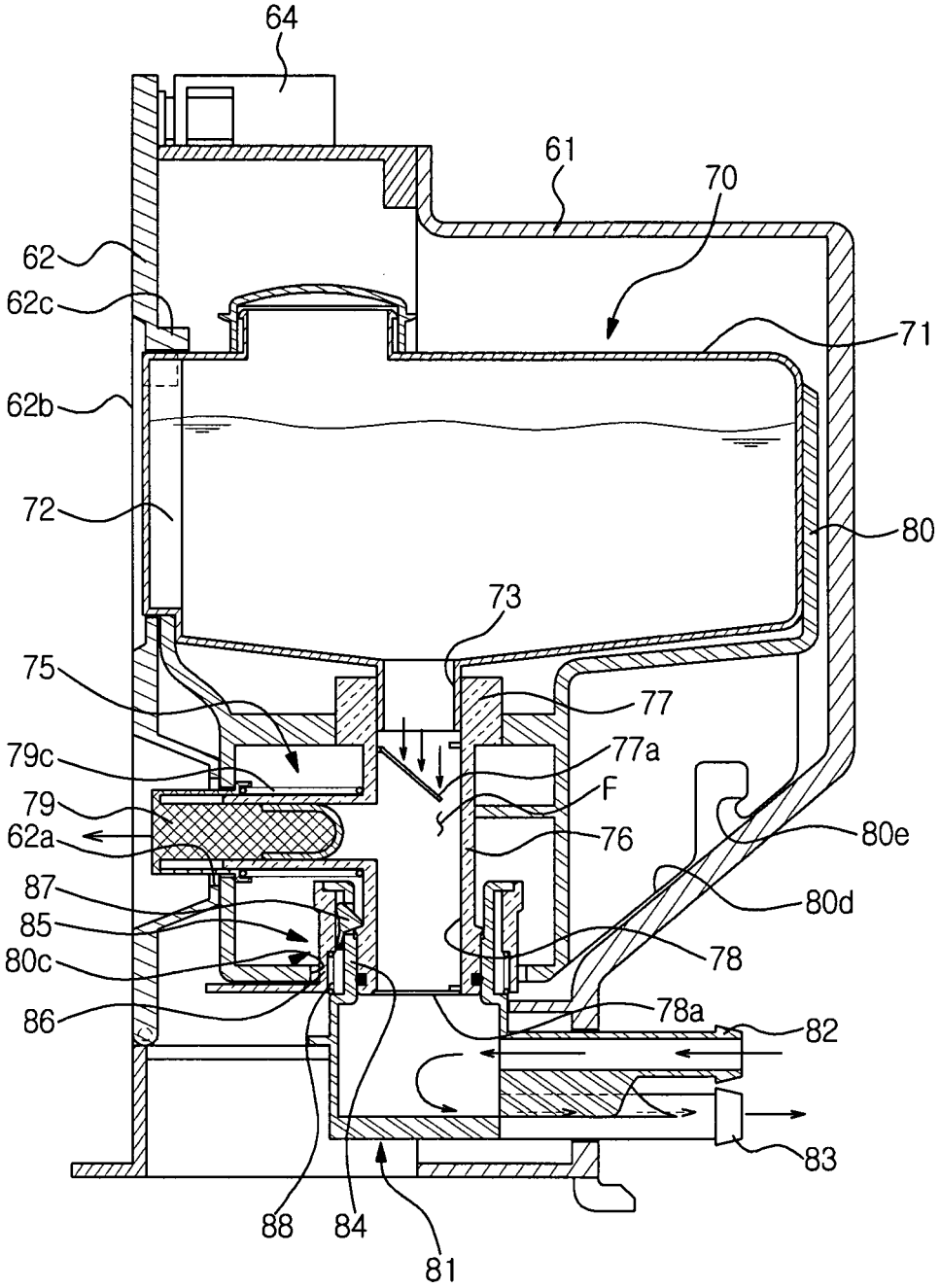
FIG. 12 is a sectional view illustrating movement of wash water after detergent is supplied by the detergent supply device according to the embodiment.

FIG. 11 is a sectional view illustrating supply of detergent via the detergent supply device according to the embodiment, and FIG. 12 is a sectional view illustrating movement of wash water after detergent is supplied by the detergent supply device according to the embodiment.

As illustrated in FIGS. 1 to 12, when the first water supply valve 42 of the upper water supply device 40 is opened, wash water may be introduced into the front end part 41*a* of the first water supply hose 41 by the hydraulic pressure of the external water supply source. Thereafter, the wash water may be supplied from the front end parts 41*a* of the plurality of first water supply hoses 41 into the first mixing unit 81*a* and the second mixing unit 81*b*.

As illustrated in FIG. 11, when the user pushes the button 79 and thus, the second check valve 78*a* is opened, detergent stored in the detergent tank 71 may be supplied into the mixing unit 81. More specifically, upon implementation of a washing operation, the user may push a first button 79*a* of the valve unit 75 that communicates with the first detergent tank 71*a* thereby supplying detergent stored in the first detergent tank 71*a* into the first mixing unit 81*a*. Then, upon implementation of a rinsing operation, the user may push a second button 79*b* of the valve unit 75 that communicates with the second detergent tank 71*b* thereby supplying detergent stored in the second detergent tank 71*b* into the second mixing unit 81*b*. In this way, wash water may be mixed with liquid-phase detergent within the first mixing unit 81*a*, or may be mixed with fabric softener within the second mixing unit 81*b*.

As illustrated in FIG. 12, when the user is not pressing the button 79, the button 79 is returned to an original position thereof by the first elastic member 79*c*, thus causing the second check valve 78*a* to be closed. The second check valve 78*a* may prevent the mixture of wash water and detergent in the mixing unit 81 from backflowing into the valve unit 75. The hydraulic pressure of the external water supply source may be maintained even in the mixing unit 81 and the mixture of wash water and detergent in the mixing unit 81 may be moved to the rear end part 41*b* of the first water supply hose 41. In conclusion, the mixture of wash water and detergent in the mixing unit 81 may be supplied from into the upper wash tub 31 through the rear end part 41*b* of the first water supply hose 41 by the hydraulic pressure of the external water supply source.

In the meantime, the lower detergent supply device 22 may supply detergent into the lower wash tub 32. The lower detergent supply device 22 may include a detergent box 22*a* in which detergent is stored.

The lower detergent supply device 22 may be provided at a certain position of the second water supply hose 51. The second water supply hose 51 may have a front end part 51*a* that connects the external water supply source and the detergent box 22*a* to each other, and a rear end part 51*b* that connects the detergent box 22*a* and the lower wash tub 32 to each other.

Wash water may be moved into the detergent box 22*a* through the front end part 51*a* of the second water supply hose 51 by the hydraulic pressure of the external water supply source. The wash water may be mixed with detergent in the detergent box 22*a*. Thereafter, the wash water may free fall into the lower wash tub 32 through the rear end part 51*b* of the second water supply hose 51.

Figure 13:
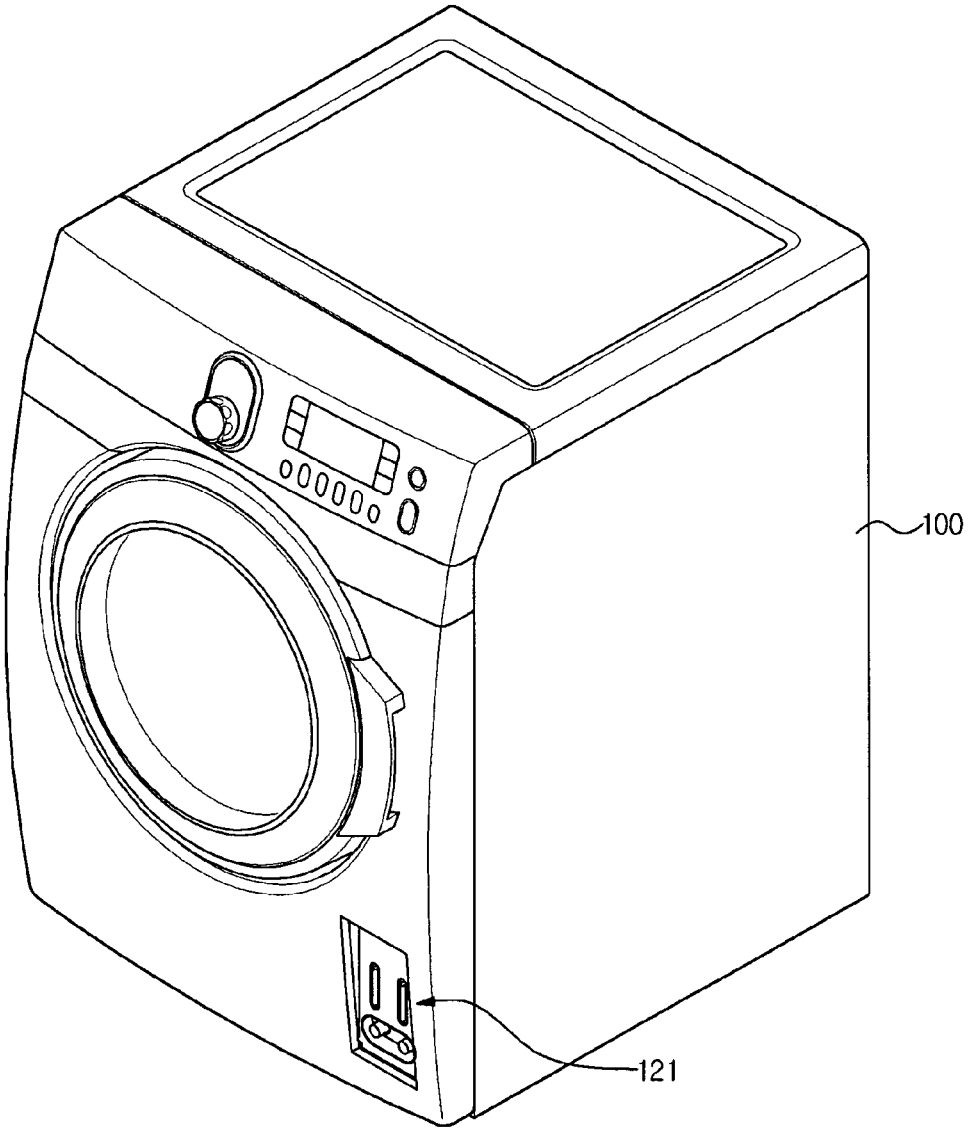
FIG. 13 is a perspective view illustrating an exterior appearance of a washing machine according to another embodiment.

FIG. 13 is a perspective view illustrating an exterior appearance of a washing machine according to another embodiment.

FIGS. 1 to 12 illustrate a multistage type washing machine in which the upper wash tub 31 and the lower wash tub 32 are stacked vertically. In this type of washing machine, since the upper detergent supply device 21 is arranged higher than the lower detergent supply device 22, the upper detergent supply device 21 is located immediately below the upper wash tub 31 at a position which the user may conveniently access. To this end, it may be important to maintain the hydraulic pressure of the external water supply source in the entire region of the first water supply hose 41, so that the upper detergent supply device 21 may supply detergent or wash water into the upper wash tub 31 located thereabove.

On the other hand, FIG. 13 illustrates a washing machine in which a single wash tub (not shown) is installed in a cabinet 100. A detergent supply device 121 of FIG. 13 may have the same configuration as the detergent supply device 21 of FIGS. 1 to 12. Accordingly, the hydraulic pressure of the external water supply source may be maintained in a passage of the detergent supply device 121 of FIG. 13 and therefore, an installation position of the detergent supply device 121 may be freely changed.

As apparent from the above description, a washing machine according to an embodiment may prevent detergent from remaining in a detergent supply device, thus keeping the washing machine clean.

Further, an installation position of the detergent supply device may be freely changed because a hydraulic pressure of wash water may be kept constant.

Furthermore, the input amount of detergent may be adjusted via mechanical operation without assistance of an electrical device.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A washing machine comprising:

an upper wash tub in which wash water is stored;

a lower wash tub disposed under the upper wash tub;

an upper detergent supply device to supply detergent into the upper wash tub;

a lower detergent supply device to supply detergent into the lower wash tub;

an upper water supply hose to supply the wash water from an external water supply source to the upper detergent supply device and subsequently into the upper wash tub; and a lower water supply hose to supply the wash water from the external water supply source to the lower detergent supply device and subsequently into the lower wash tub, wherein movement of the wash water through the upper water supply hose is carried out by a hydraulic pressure of the external water supply source in an entire region of the upper water supply hose, wherein the upper detergent supply device includes a mixing unit in which the wash water supplied via the upper water supply hose and the detergent are mixed with each other, wherein the mixing unit includes a wash water inlet portion to introduce the wash water in a first direction; and a wash water outlet portion to discharge the wash water with the detergent in a second direction opposite to the first direction, and wherein both the upper and lower detergent supply devices and the upper and lower water supply hoses are disposed between the upper wash tub and the lower wash tub.

2. The washing machine according to claim 1, wherein the upper detergent supply device further includes:

a detergent tank in which the detergent is stored; and a valve unit to control supply of the detergent stored in the detergent tank.

3. The washing machine according to claim 2, further comprising a cabinet, wherein the upper water supply hose includes:

a front end part provided between the external water supply source at the outside of the cabinet and the mixing unit; and a rear end part provided between the mixing unit and the upper wash tub.

4. The washing machine according to claim 3, wherein the wash water inlet portion is connected to the front end part of the upper water supply hose for introduction of the wash water; and the wash water outlet portion is connected to the rear end part of the upper water supply hose for discharge of the wash water.

5. The washing machine according to claim 3, wherein the mixing unit includes a detergent introduction portion connected to the valve unit to receive the detergent.

6. The washing machine according to claim 2, wherein the valve unit includes:

a valve body having a predetermined passage;

a detergent inlet portion that connects the passage of the valve body and the detergent tank to each other;

a detergent outlet portion that connects the passage of the valve body and the mixing unit to each other; and a button that is movable relative to the valve body to control a pressure of the passage of the valve body.

7. The washing machine according to claim 6, wherein the valve unit further includes:

a first check valve provided at a connection region of the detergent tank and the valve body; and a second check valve provided at a connection region of the valve body and the mixing unit, wherein the button controls the pressure of the passage of the valve body to open or close the first check valve or the second check valve.

8. The washing machine according to claim 1, wherein the upper detergent supply device includes:

a detergent tank assembly having a detergent tank in which the detergent is stored;

a valve unit to control supply of the detergent stored in the detergent tank;

an inner case in which the detergent tank and the valve unit are mounted; and wherein the detergent supplied via the detergent tank assembly and the wash water supplied via the upper water supply hose are mixed with each other in the mixing unit, and the washing machine further comprises a restraint unit to allow the detergent tank assembly to be caught by or released from the mixing unit.

9. The washing machine according to claim 8, wherein the restraint unit includes:

a guide lever elastically supported on the mixing unit so as to be movable relative to the mixing unit; and a holder fitted to the mixing unit so as to be pivotally rotatable according to movement of the guide lever.

10. The washing machine according to claim 9, wherein:

the valve unit of the detergent tank assembly includes a detergent outlet portion connected to the mixing unit; and the valve unit of the detergent tank assembly further includes a holding protrusion formed at the detergent outlet portion so as to be caught by the holder.

11. The washing machine according to claim 8, wherein the detergent tank assembly includes at least one supporting portion to allow the detergent tank assembly to be supported obliquely.

12. The washing machine according to claim 8, wherein the detergent tank assembly includes at least one hook to keep the detergent tank assembly at a fixed position.

13. The washing machine according to claim 8, wherein the upper detergent supply device further includes:

an outer case in which the detergent tank assembly and the mixing unit are mounted; and a cover to open or close a front side of the outer case.

14. The washing machine according to claim 13, wherein:

the detergent tank includes a detergent gauge display made of a transparent material to display an amount of the detergent; and the cover includes a detergent gauge display hole through which the detergent gauge display penetrates.

15. The washing machine according to claim 14, wherein the cover further includes a button hole through which a button of the valve unit penetrates.

* * * * *